United States Patent [19]

Callaway

[11] 4,389,743

[45] Jun. 28, 1983

[54] MATTRESS ARRANGEMENT HAVING A REMOVABLE SIDE-INSERTABLE CENTER CORE STRUCTURE

[75] Inventor: Milton A. Callaway, Jackson, Oreg.

[73] Assignee: Simmons U.S.A. Corporation, Atlanta, Ga.

[21] Appl. No.: 276,173

[22] Filed: Jun. 22, 1981

[51] Int. Cl.[3] ..... A47C 27/15; A47C 27/04

[52] U.S. Cl. ..... 5/464; 5/465; 5/470; 5/474

[58] Field of Search ..... 5/474, 462, 464, 465, 5/470, 471, 449, 450, 451, 482, 485

[56] References Cited

U.S. PATENT DOCUMENTS

| | | |
|---|---|---|
| 1,371,362 | 3/1921 | Giese . |
| 1,393,255 | 10/1921 | Conlan . |
| 1,741,847 | 12/1929 | Kaspar . |
| 1,892,679 | 1/1933 | Penner . |
| 1,914,661 | 6/1933 | Burke . |
| 1,955,583 | 4/1934 | Hoffey . |
| 2,000,873 | 5/1935 | Arens . |
| 2,010,728 | 8/1935 | Kleiner . |
| 2,425,728 | 8/1947 | Cobb . |
| 3,191,197 | 6/1965 | Frey . |
| 3,241,161 | 3/1966 | Dashosh . |
| 3,308,490 | 3/1967 | Cacioppo . |
| 3,732,586 | 5/1973 | Frey . |
| 3,939,508 | 2/1976 | Hall et al. . |
| 3,950,798 | 4/1976 | Borsini . |
| 3,950,800 | 4/1976 | Garshfield . |
| 4,234,983 | 11/1980 | Stumpf . |
| 4,234,984 | 11/1980 | Stumpf . |
| 4,245,363 | 1/1981 | Callaway . |

FOREIGN PATENT DOCUMENTS

| | | | |
|---|---|---|---|
| 555821 | 8/1957 | Belgium . | |
| 496756 | 4/1930 | Fed. Rep. of Germany | 5/474 |
| 2117333 | 9/1972 | Fed. Rep. of Germany . | |
| 743353 | 3/1933 | France . | |
| 495132 | 1/1954 | Italy . | |
| 1286299 | 8/1972 | United Kingdom . | |

*Primary Examiner*—Alexander Grosz

*Attorney, Agent, or Firm*—Scully, Scott, Murphy and Presser

[57] ABSTRACT

A mattress arrangement including an outer perimeter frame structure having rigid supports extending thereabout. An opening at one end of the frame structure facilitates the insertion of a mattress core through that end in a "cassette-like" manner, with the outer end of the core forming an extension of the frame support structure.

39 Claims, 9 Drawing Figures

MATTRESS ARRANGEMENT HAVING A REMOVABLE SIDE-INSERTABLE CENTER CORE STRUCTURE

BACKGROUND OF THE INVENTION

1. Field of the Invention

The present invention relates to a mattress arrangement and, more particularly, relates to a mattress construction having separable and replaceable mattress portions so as to provide for a mattress incorporating variable physical characteristics or consistencies in conformance with consumer requirements.

An important aspect in mattress construction lies in the provision of a mattress which affords a maximum degree of comfort to the individual user, particularly with respect to the firmness obtained through the internal construction thereof, and especially with regard to the center portion or core section of the mattress which is subjected to extensive use. Inasmuch as different users require and demand mattresses having a wide variety of consistencies and degrees of firmness, it is readily understandable that, in order to be able to satisfy a broad range of consumer demands, this would necessitate the manufacture of many types of mattresses affording the consumer a wide choice of selection. Obviously this presents problems in the economy of manufacturing and stocking of a large supply of mattresses having different characteristics and firmness in order to be able to meet most consumer needs. In order to ameliorate these problems, there has thus been developed the concept of providing a basic mattress frame or perimeter construction which, in combination with a replaceable and interchangeable core portion forming the major supporting area of the mattress, facilitates the rather inexpensive manufacture of the mattress while imparting a versatility in construction and adaptability to consumer needs not heretofore encountered in the prior art.

2. Discussion of the Prior Art

Heretofore, some effort has been expended in the industry relative to the equipping of a generally basic outer mattress frame or structure with a replaceable center or mattress core section.

Burke U.S. Pat. No. 1,914,661 discloses a mattress having an outer frame structure covered by a suitable mattress ticking, in which one side is adapted to be opened so as to afford access to the interior of the mattress. The interior of the mattress is constituted of a plurality of fillers which may be readily inserted and removed to allow for replacement by other similar fillers or for the cleaning of the existing fillers.

Hoffey U.S. Pat. No. 1,955,583 relates to a mattress arrangement in which an outer cushioned mattress frame structure incorporates a slide fastener or zipper construction along an end surface to allow for the insertion or removal of a coil spring inner core section. In another embodiment, Hoffey discloses a construction designed for the insertion of a plurality of filler core sections into an outer mattress frame.

Similar mattress constructions, which provide for the sidewall insertion of central core sections or mattress inserts into an encompassing or perimetral frame structure, are disclosed in Arens U.S. Pat. No. 2,000,873; Kleiner U.S. Pat. No. 2,010,728; French Pat. No. 743,353; Italian Pat. No. 495,132; and Belgian Pat. No. 555,821.

Although the above-mentioned prior art patents each disclose mattress arrangements in which an inner core section is insertable into an outer mattress frame, none disclose the particular construction contemplated by the mattress arrangement pursuant to the invention.

SUMMARY OF THE INVENTION

The present invention essentially provides for a mattress arrangement which includes a generally rigid and essentially self-supporting outer peripheral frame structure which may be covered by a suitable covering material, such as ticking or a quilted or tufted mattress pillow material, in which an opening is provided at one end of the peripheral frame and in which an openable flap is formed in the covering material over the opening. At least one inner core section which forms substantially the major mattress support surface for one or more users is adapted to be slid in a "cassette-like" manner through the opening into the frame structure. Thereafter the flap may be closed and fastened to provide a complete mattress arrangement having a rigid outer peripheral frame structure and center mattress core which is adapted to the needs of the individual user.

Moreover, the end of the center mattress core which, after insertion of the core into the outer frame structure, is in coextensive alignment with the opening formed in the outer frame structure, may be provided with a support structure of a property or resilience analagous to that of the peripheral frame structure so as to ensure that the entire outer periphery of the mattress has a consistent rigidity and support imparted thereto.

An important aspect of the present invention resides in that the insertable core concept for the mattress arrangement facilitates an adaptability for showroom demonstration which emphasizes the versatility thereof to potential customers. In effect, the insertable and interchangeable core imparts a "customized" property to the mattress without the need for expensive modifications to the basic mattress construction. Thus, a wide range of customer needs and individual tastes can be demonstrated in a simple and inexpensive manner through a simple interchange of the core position of the mattress in a standardized outer perimeter frame structure.

Another feature of the inventive mattress arrangement consists of its ready adaptability to field servicing and replacement of worn or damaged mattress components without the need to return the mattress to a factory or the use of skilled servicing personnel.

In addition to the foregoing, the insertable core allows for the insertion therebeneath of an orthopedic bed board into the perimeter support structure by either the user or by personnel in the retail outlet selling or servicing the mattress arrangement. This, of course, again enlarges the scope of application of the mattress arrangement to a wider public and enhances the saleability of the product.

Accordingly, it is a primary object of the present invention to provide a mattress arrangement having an outer peripheral frame structure and a center mattress core insertable through a side of the frame structure.

A more specific object of the invention resides in the provision of a mattress arrangement of the type described in which the center mattress core is adapted to be inserted into the outer peripheral mattress frame structure through an opening formed in the side of the frame structure in a "cassette-like" manner.

Yet another object of the present invention comprises the provision of a mattress arrangement as described herein which is adapted for showroom demonstrations of numerous variations thereof so as to apprise potential customers of the versatility of the arrangement.

A further object of the present invention contemplates the novel mattress arrangement as being capable of having an orthopedic bed board installed therein for application to the needs of consumers requiring such a medical aid.

A still further object of the present invention resides in the provision of a mattress arrangement with an insertable core of the type described which is adapted for servicing and replacement by other mattress components in the field.

BRIEF DESCRIPTION OF THE DRAWINGS

Reference may now be had to the following detailed description of a mattress arrangement constructed pursuant to the present invention, taken in conjunction with the accompanying drawings; in which.

DETAILED DESCRIPTION

Figure 1:
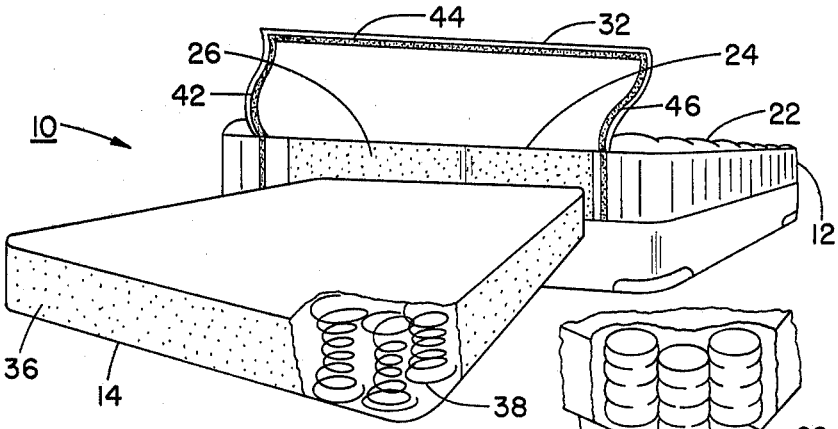
FIG. 1 illustrates in a perspective view, partly in section, a mattress arrangement pursuant to the invention, with the center mattress core shown in a position prior to insertion into the peripheral mattress frame structure.
Figure 2:
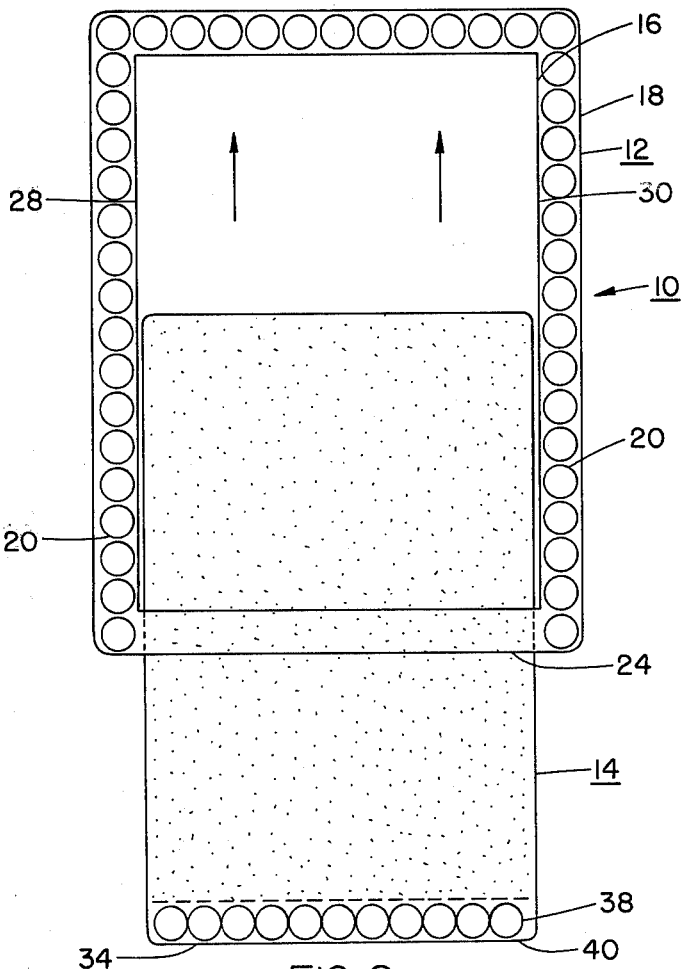
FIG. 2 shows a sectional and schematic top plan view of the mattress arrangement with the center core section being in a partially inserted position.

Referring now in detail to the FIGS. 1 and 2 of the drawings, a mattress arrangement 10 includes an outer perimeter or peripheral frame structure 12 and an inner mattress core 14.

The outer frame structure 12 may include encompassing upper and lower border wires consisting of inner wires 16 and outer wires 18 of round, rectangular or any suitable cross-section which are interconnected by a plurality of spring coils 20 extending about the perimeter of the frame structure 12. The wires 16, 18, and the spring coils 20 form a generally rigid but resiliently yieldable rectangular mattress frame adapted to comfortably support the weight of a person sitting on the edge of the mattress while concurrently maintaining the shape of the mattress. The coils may be constituted of metal or of a suitable plastic material which is adapted to simulate or duplicate the physical and resilient properties of the metal. This is also applicable relative to the material employed for the wires. The outer frame structure 12 may be covered on all exposed sides thereof with a suitable covering material 22, which may consist of mattress ticking, or a tufted or quilted mattress pillow material which imparts a soft and luxuriant look and feel to the mattress. The mattress covering material may, if desired, consist of an either woven or non-woven breathable fabric, such as synthetic fiber material, cotton or combinations of materials which afford the necessary comfort to a user resting or sleeping on the mattress. Moreover, the mattress arrangement may incorporate a mattress pillow top filled with down or other soft foam-like material which will impart a particularly full and luxuriant look and texture to the mattress.

At one end 24 of the outer peripheral frame 12, the coil springs 20 are omitted so as to leave an opening 26 between the upper and lower wires, in general conformance with the width between the inner wires 16 extending along opposite sides 28 and 30 of the frame structure 12.

In lieu of the inner and outer border wires 16 and 18 and the spring coils 20, the peripheral frame structure 12 may be constructed of pocketed springs, or may be constructed of a plastic or foamed material, or of wood and the like.

Thus, for instance, the peripheral frame structure 12 may consist of a rectangular or so-called "square" array or arrangements of non-nested pocketed spring coils in which adjacent pocketed strips of springs are interconnected by connecting the fabric strips together between springs, for example, by stitching, seaming, or thermal and/or ultrasonic welding of the seams of the material or of the fabric strips, the material preferably being non-woven thermoplastic fiber material, rather than by connecting of the springs so that the interconnection of any spring with its adjacent springs is accomplished in the same manner, in essence, through the material in which the spring is housed. This type of pocketed coil spring structure eliminates the tendency exhibited by nested assemblies of pocketed coil springs to trap an individual coil or coils in a partially compressed condition. Such a structure is disclosed in Stumpf U.S. Pat. No. 4,234,984 assigned to the Simmons Company, the disclosure of which is incorporated herein by reference thereto.

Figure 6:
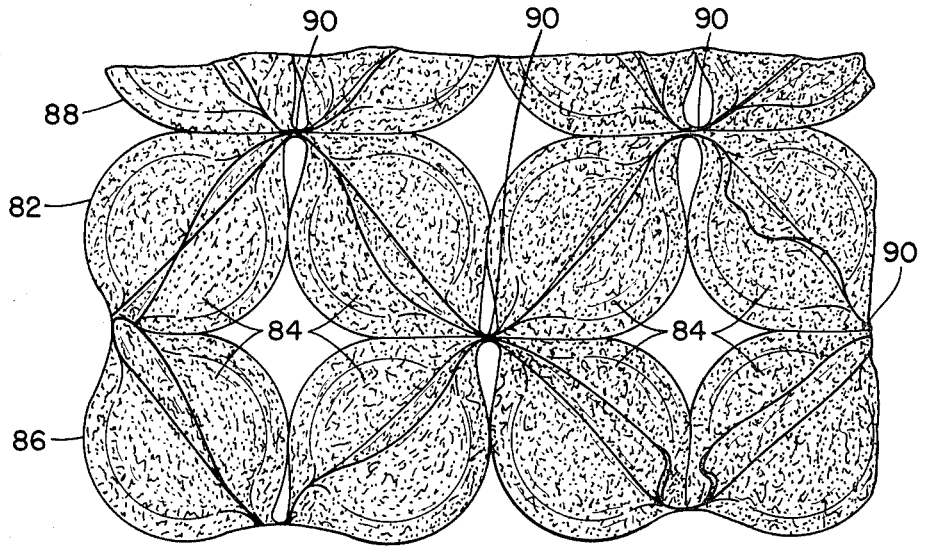
FIG. 6 is an enlarged plan view of a corner face of a rectangular pocketed spring assembly with the springs disposed in non-nested square array.
Figure 7:
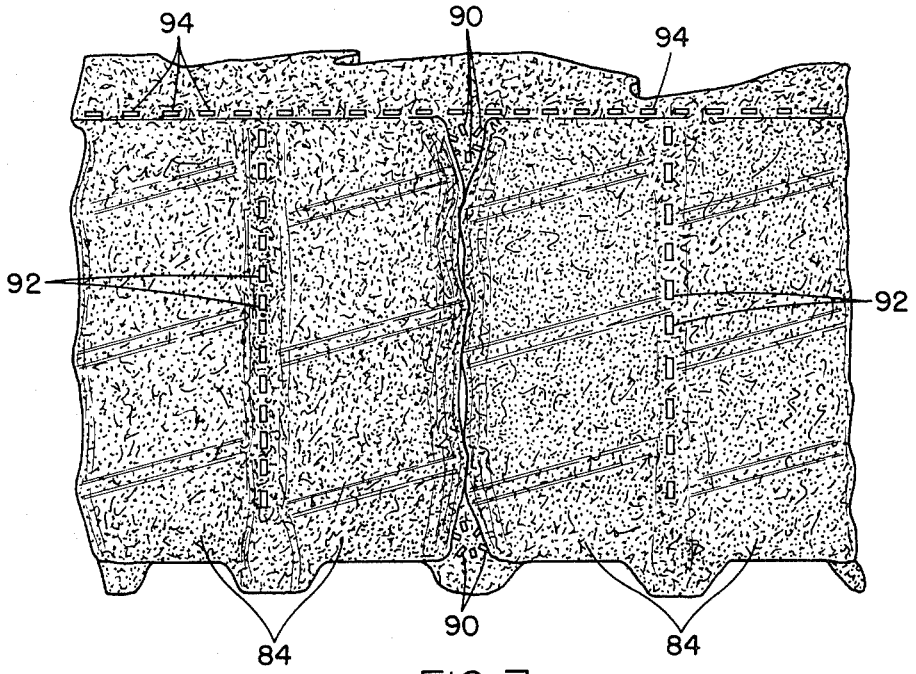
FIG. 7 is a fragmentary elevational view of the assembly of FIG. 6.

In this instance, in a pocketed spring assembly a given strip 82 of pocketed springs 84 is connected to each adjacent strip 86 and 88 by connecting the two fabric strips together. Inasmuch as the overall pattern of the assembly tends to confuse the eye, reference should be made initially to the fragmentary enlargements of FIGS. 6 and 7, from which it will be more readily seen that the connections 90 of a given strip of springs to its neighboring strip are made between a pair of successive springs 84 of each strip, and are alternated along any given strip, e.g., strip 82, so that the given strip is connected first to the neighboring strip on one side, e.g., strip 86, and then to the neighboring strip on the opposite side, e.g., strip 88, and so forth, along the entire given strip from one end or side of the assembly to the other.

The interstrip connections 90 are conveniently, although not necessarily, made near the opposite faces of the spring assembly, where, because of the preferred barrel shape of the coil, the slack of the fabric between successive pockets near the ends of the coils facilitates the insertion of a tool (not shown) appropriate to make the connection.

As a result of the connection, the pair of coils of each strip immediately adjacent to the interstrip connection 90 are joined with an opposing pair in a configuration which, in plan, resembles a four-leaf clover, each spring pocket being rotated approximately one-eight turn away from the longitudinal axis of its own strip.

The strips of pocketed coils 88 chosen to illustrate the invention are those produced commercially by the assignee of this invention and comprise a folded two-ply strip of non-woven fabric of thermoplastic fibers in which the spring pockets are defined between the plies by transverse lines 92 of discrete thermal welds of the plies to one another, and in which the pockets formed in the two-ply strip are closed by a longitudinal seam 94 of similar thermal welds to confine the springs in the pockets. When the springs are permitted to expand after being confined within the pockets, they impose their shapes upon the confining pocket walls in the mid-height of the pockets and produce a ruffle in the flaps of the closing seam, and at the opposite non-seamed end of the spring pocket as well, as the separation of the plies by the expanded spring foreshortens the cloth strip. This results in a slack reach of fabric along the inter-pocket seam 92 at each end thereof, an effect accentuated somewhat by the barrel shape of the coils 84 with which the invention is specifically illustrated.

The divergence of adjacent spring coils 84 at their ends resulting from the barrel shape provides convenient access to the strip material which, in the illustrated instance is welded to the material of the adjacent strip in the corresponding reaches of fabric between two successive coils of each strip, so that in the presently preferred and illustrated form, the adjacent strips are connected together, as at 90 near the tops and bottoms of the coils, but preferably interiorly of the end convolutions thereof.

The assembly of springs by connecting the strips together, rather than by connecting the springs, as such, to one another, permits each spring to maintain a considerable degree of individual action before requiring the depression of its neighbors in the clover leaf array, and yet, beyond that point, as in areas of concentrated load under the proportionally heavier parts of the body, or when the spring assembly is highly loaded as by bearing the weight of the occupant in sitting position, the clover leaf connection of four springs together in a closely knit group associates them cooperatively so that each can assist the other to regain the full unloaded height permitted by the confining pocket when the concentrated load is subsequently removed.

The pocket material of the preferred assembly is a thermoplastic sheeting, preferably of fibrous material whether or not of continuous filament or staple fiber length, and whether spun and woven, or laid as a non-woven fabric. When the constituent material is thermoplastic, as indicated, the joining technique employed in making the assembly, as well as making the pocketed spring strip itself, may be thermal welding, a localized or spot attachment of adjacent strips being made at or near the end convolutions of the springs along the seam between adjacent pockets in that relatively slack reach of the pocket material provided by the diverging outlines of the barrel-shaped spring coils resulting from the smaller diameter of their respective end convolutions. These connections can readily be made with available welding equipment, and do not appear to interfere materially with compression of the springs individually through a substantial portion of their respective heights.

Based upon the considerable history of manufacture of pocketed spring coil assemblies wherein the pocket materials were of spun and woven staple fibers of natural origin, the specific mode of attachment of adjacent strips to one another in accordance with the invention may be something specifically different from thermal welding, the ultimate objective being the secure, reliable, and non-destructive attachment of the adjacent strips to one another. This may, for example, take the form of stitching, or twine ties, or metal fasteners such as hogrings, staples, or the like, or an adhesive capable of adequately penetrating the four plies of a textile fabric with or without heat and pressure. At one end of the frame structure, a space may be provided between the pocketed spring coils, the resultant opening being reinforced by, for example, upper and lower stiffening wires or the like.

Similarly, the peripheral frame structure may consist of non-nested pocketed upholstery springs assembled into the so-called Marshall construction as described in Stumpf U.S. Pat. No. 4,234,983, assigned to the Simmons Company, the disclosure of which is incorporated herein by reference thereto. In this instance the pockets with the individual coil springs are formed between overlaid plies of a two-ply strip of material by lines of separate individual welds which interconnect the plies. These welds between the material plies may be effected in an ultrasonic method and arrangement.

Figure 8:
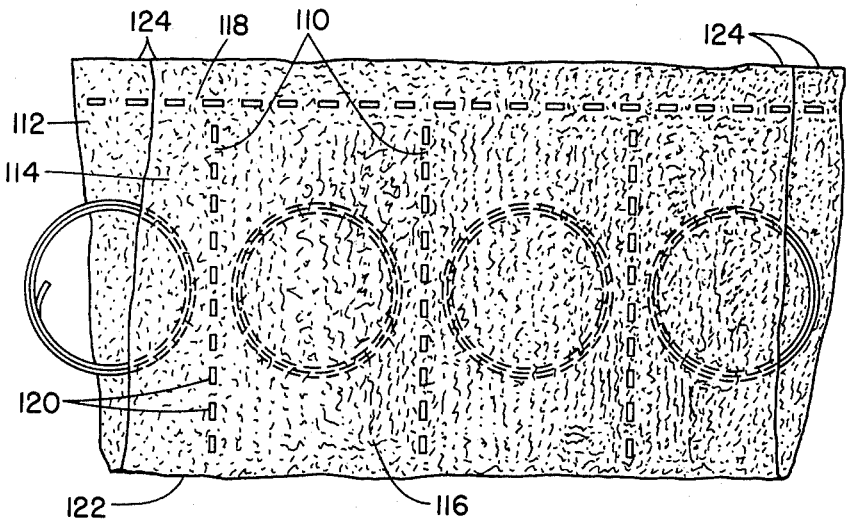
FIG. 8 is an enlarged plan view of a series of pocketed springs of the so-called Marshall construction.
Figure 9:
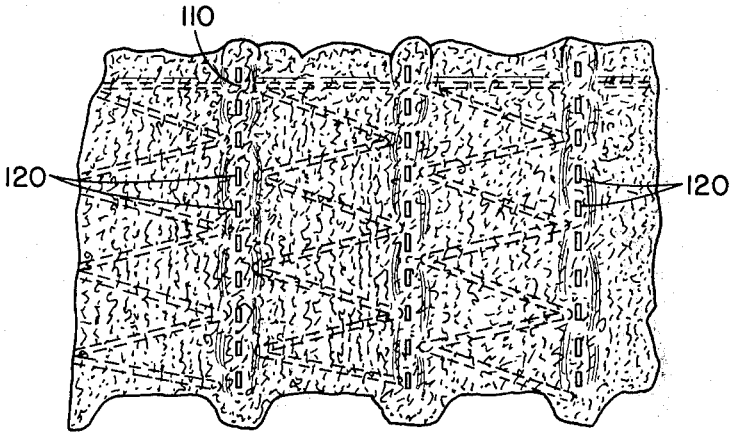
FIG. 9 is a fragmentary elevational view of the springs of FIG. 8.

As illustrated in FIGS. 8 and 9, the transverse lines of attachment 110 of the overlaid plies 112 and 114 of the strip 116 to each other to define the spring pockets, as well as the line 118 of attachment which closes the pockets along the side edges of the plies between which the spring was inserted, are formed of discrete individual welds 120 rather than as a continuous weld. It will also be observed that, as illustrated, the individual welds 120 are spaced apart within the line by a distance approximately equal to the length of the individual welds along the line, and, further, that the welds at each end of the transverse lines 110 of welds between the pockets do not intercept either the folded edge 122 of the fabric strip 16 or its overlaid edges 124 between which the spring was inserted.

With an interrupted line of thermal welds and using nonwoven polypropylene fabric earlier referred to, a line of interrupted welds each a quarter-inch long and approximately one-eight inch wide and separated from each other by approximately one-quarter inch in the line, exhibits over forty percent (40%) greater resistance to separation of the pocket-forming plies than the identical material sewed on production equipment for the manufacture of pocketed springs by the conventional stitching method, using thread which is conventional for the single-thread interpocket stitching, viz., Number 30-3 soft cotton.

While thermal welding in the prescribed pattern may be achieved in a variety of ways, including contact heating and high frequency welding the ultrasonic welding technique appears to be especially suitable in that the internal induction of heat by its mechanical working of the material is faster than contact heating, and more controllable as well as less dangerous than high-frequency electrostatic methods. Moreover, within limits, any desired pattern of welding can be achieved ultrasonically in this context by suitable modification of the anvil against which the material to be welded is pressed by the welding horn.

The outer peripheral frame structure 12 may also be found to be of rigid plastic material components and of foamed plastic cushioning material in lieu of the springs or in combination therewith, or of wood and the like natural materials.

The side of the frame structure 12 at end 24 has an openable flap 32 formed in the covering material 22 so as to afford access to the interior of the frame structure when the flap 32 is lifted up. At that time it is possible to insert an inner mattress core 14 into the frame structure 12 through the opening 26 between the upper and lower wires. When the mattress core 14 is fully inserted it substantially fully fills the space within the frame structure 12, while its outermost end 34 is generally flush with the outer end surface of the frame structure 12 at its end 24.

Inner mattress core 14 may be covered with a suitable covering material 36 on all sides thereof, such as with mattress ticking. When the core 14 is constituted of pocketed coil springs then these may be covered by a muslin forming the pocket fabric which, in turn, may comprise the covering material of the mattress core. In addition to the foregoing, the core may be covered with material similar to that employed for the outer frame structure. In effect, the core may be covered with woven or non-woven breathable synthetic or natural fiber material; may be quilted or tufted, and the like. In order to ensure that the mattress arrangement 10 provides for rigidity and support along all four edges thereof, the core 14 may incorporate coil springs 38, or pocketed coil springs or other suitable support structure along the edge 40 of the core which is located within the frame structure 12 at end 24. These coil springs 38, or other support structure, are then located within the outer frame end and, in effect, become a part of the outer frame structure 12 in their physical position and operation.

In essence, the inner mattress core 14 may have a structure or physical characteristic in conformance with the needs of the user or purchaser of the mattress. For example, the core 14 may be formed of a coil spring arrangement including border wires; or may be constructed of non-nested pocketed coil springs pursuant to either Stumpf U.S. Pat. Nos. 4,234,983 or 4,234,984; or may incorporate a flotation or waterbed mattress center as shown in Callaway U.S. Pat. No. 4,245,363; or may have a pneumatic or foam-filled core construction.

The end of the mattress core 14 which contains the support structure or coil springs 38 which is arranged within the frame structure 12 at end 24 of the latter, may have a structure, in effect, coil springs, pocketed coil springs or the like, consistent with the structure of the perimeter frame structure. Alternatively, this end of the mattress core 14 may be constituted of the same construction as the outer frame structure 12; in essence, it may be constituted of plastic material, cushioning or wood and the natural materials.

After insertion of the inner core 14 into the outer frame structure 12, the flap 32 is folded down over the opening 26 and secured along its edges 42,44,46 to the covering material 22. The edges 42,44,46 may be fastened to the covering material 22 through suitable fastening means such as slide fasteners, i.e. zipper, or through stitching with a Velcro seam (registered trademark). Moreover, under circumstances, from an aesthetic veiwpoint it may be desirable that the fastening means are not exposed to view. Accordingly, the covering material may incorporate suitable material flap structure which will cover the fastening means upon closure of the latter.

Figure 3:
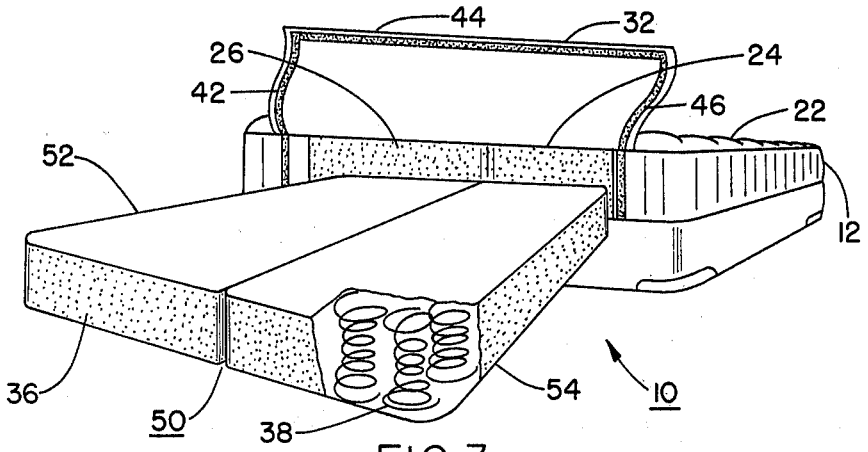
FIG. 3 illustrates a view similar to FIG. 1 or another embodiment of a mattress arrangement being a center mattress core constituted of two separate core sections.
Figure 4:
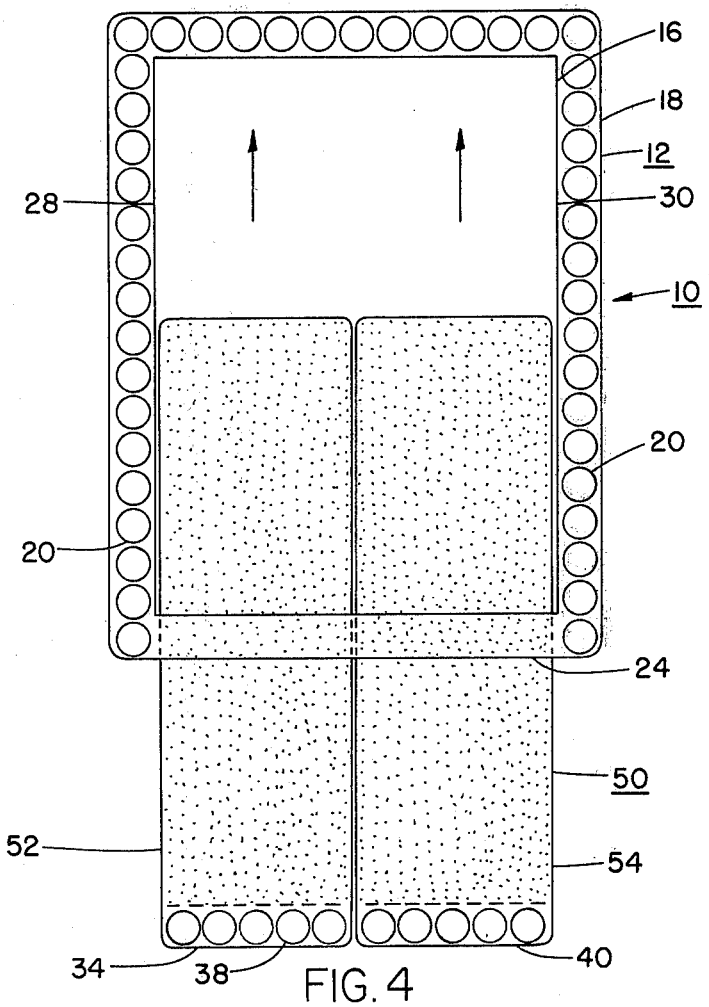
FIG. 4 illustrates a top plan view of the mattress arrangement of FIG. 3.

Referring now to the embodiment illustrated in FIGS. 3 and 4 of the drawings, in which identical or similar components to those in FIGS. 1 and 2 are designated by the same reference numerals, instead of an inner mattress core 14 consisting of a single insertable core section, an inner mattress core 50 consists of two separate core sections 52,54 insertable side-by-side into the peripheral frame structure. This arrangement will allow the use of core sections each having their own individual physical properties, in effect, a core section 52 which may incorporate a coil spring or pocketed coil spring structure, and a core section 54 which may be a flotation mattress or a foam-filled core; or an air-filled core, a rubber core, or any permutation of these. The core 14 may also be covered with suitable mattress covering material, such as woven or non-woven breathable synthetic or natural fiber material.

This is of particular significance when applied to a double bed or a large mattress arrangement used by more than one person, in which each side of the bed can then be correlated with the needs of the user supported on that side of the mattress arrangement.

Instead of two core sections 52,54 it is also possible to contemplate the utilization of three or even more adjoining core sections having identical or differing physical properties in accordance with need.

Figure 5:
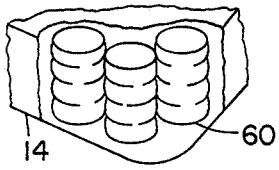
FIG. 5 illustrates a fragmentary portion of another embodiment of a mattress core.

Having reference to the mattress core 14 illustrated in FIG. 5 of the drawings, in essence this is quite similar to that of the preceding described embodiments; however, in this instance instead of coil springs and border wires, the core structure incorporated non-nested pocketed coil springs 60 in conformance with the construction of the above-mentioned Stumpf U.S. patents.

From the foregong it thus becomes obvious to one skilled in the art that by simply substituting an inner mattress core having different physical properties and consistencies in place of an existing core, or by inserting a special mattress core (orthopedic or the like), it is possible in a simple and inexpensive manner to produce a mattress arrangement adapted to fulfill the needs of a broad range of consumer demands.

In certain instances, so as to impart to the mattress arrangement a still fuller and more luxuriant look, a unitary piece of foamed material or sponge-like rubber material may be inserted in the cavity beneath the mattress core. This will cause the center position of the mattress to arc upwardly into a dome appearance, generally referred to as a "loft", thereby creating an especially attractive and expensive appearing mattress.

Additionally, if desired, the mattress arrangement may incorporate suitable heating devices; air circulation devices for heating, or the like.

What is claimed is:

1. A mattress arrangement including a removable and interchangeable mattress center core structure locatable within a mattress perimeter section, comprising in combination:

(a) a substantially rigid mattress perimeter structure including support means defining the perimeter outline of said mattress, said support means having an opening communicating with the interior of said mattress arrangement along one side of said mattress perimeter, (b) and at least one mattress core section being insertable into said mattress perimeter structure through said opening, said core section being dimensioned to form a complete mattress arrangement in conjunction with said perimeter structure and having one end thereof defining a portion of the perimeter structure.

2. A mattress arrangement as claimed in claim 1, comprising support means is said core section extending along at least said one end of said mattress core section coextensive with said mattress perimeter structure, said support means in said core section being adapted to form the mattress perimeter structure support segment located within said perimeter opening.

3. A mattress arrangement as claimed in claim 1 or 2, said support means of said mattress perimeter structure comprising wire means defining the perimeter outline of said mattress; and coil spring means being fastened to said wire means and spaced about the perimeter of said mattress, said coil spring means being spaced to define said opening.

4. A mattress arrangement as claimed in claim 3, said wire means and coil spring means being formed of a metallic material.

5. A mattress arrangement as claimed in claim 3, said wire means and coil spring means being formed of a plastic material.

6. A mattress arrangement as claimed in claim 1 or 2, said support means of said mattress perimeter structure comprising pocketed coil springs.

7. A mattress arrangement as claimed in claim 6, said pocketed coil springs comprising non-nested coil springs.

8. A mattress arrangement as claimed in claim 6, said pocketed coil springs being interconnected through ultrasonic welding of the material housing said coil springs.

9. A mattress arrangement as claimed in claim 6, said pocketed coil springs being formed of a metallic material.

10. A mattress arrangement as claimed in claim 6, said pocketed coil springs being formed of a plastic material.

11. A mattress arrangement as claimed in claim 1 or 2, comprising a plurality of said mattress core sections being insertable into said mattress perimeter structure in adjoining relationship.

12. A mattress arrangement as claimed in claim 1 or 2, comprising mattress covering material respectively encompassing said mattress perimeter structure and said core section, an openable flap portion being formed in the material covering said perimeter structure over said perimeter opening to facilitate insertion and withdrawal of said core section through said opening; and fastening means for securing said flap portion to said covering material to form a closed material surface over said opening upon insertion of said core section.

13. A mattress arrangement as claimed in claim 12, said covering material covering said fastening means upon closure of the latter.

14. A mattress arrangement as claimed in claim 12, said fastening means comprising cooperating slide fastener means on said flap portion and on said covering material.

15. A mattress arrangement as claimed in claim 12, said covering material comprising mattress ticking.

16. A mattress arrangement as claimed in claim 12, said covering material comprising tufted mattress pillow material.

17. A mattress arrangement as claimed in claim 12, said covering material comprising a woven breathable fabric.

18. A mattress arrangement as claimed in claim 12, said covering material comprising a non-woven breathable fabric.

19. A mattress arrangement as claimed in claim 12, said covering material including a pillow top mattress covering.

20. A mattress arrangement as claimed in claim 19, said pillow top including a down filling.

21. In a mattress arrangement comprising a mattress perimeter structure adapted to have at least one removable and interchangeable mattress center core structure located within said mattress perimeter structure, said perimeter structure being a substantially rigid structure including support means defining the perimeter outline of said mattress, said support means having an opening communicating with the interior of said mattress arrangement along one side of said mattress perimeter whereby at least one mattress core section is insertable into said mattress perimeter structure through said opening.

22. A mattress perimeter structure as claimed in claim 21, said support means of said mattress perimeter structure comprising wire means defining the perimeter outline of said mattress; and coil spring means being fastened to said wire means and spaced about the perimeter of said mattress, said coil spring means being spaced to define said opening.

23. A mattress perimeter structure as claimed in claim 21 or 22, said support means of said mattress perimeter structure comprising pocketed coil springs.

24. A mattress perimeter structure as claimed in claim 23, said pocketed coil springs comprising non-nested coil springs.

25. A mattress perimeter structure as claimed in claim 23, said pocketed coil springs being interconnected through ultrasonic welding of the material housing said cell springs.

26. A mattress perimeter structure as claimed in claim 23, said pocketed coil springs being formed of a metallic material.

27. A mattress perimeter structure as claimed in claim 23, said pocketed coil springs being formed of a plastic material.

28. A mattress perimeter structure as claimed in claim 22, said wire means and coil spring means being formed of a metalllic material.

29. A mattress perimeter structure as claimed in claim 22, said wire means and coil spring means being formed of a plastic material.

30. A mattress perimeter structure as claimed in claim 21 or 22, wherein a plurality of mattress core sections are adapted to be inserted into said mattress perimeter structure in an adjoining relationship.

31. A mattress perimeter structure as claimed in claim 21 or 22, comprising mattress covering material encompassing said mattress perimeter structure, an openable flap portion being formed in the material covering said perimeter structure over said perimeter opening to facilitate insertion and withdrawal of said core section through said opening; and fastening means for securing said flap portion to said covering material to form a closed material surface over said opening upon insertion of said core section.

32. A mattress arrangement as claimed in claim 31, said covering material covering said fastening means upon closure of the latter.

33. A mattress perimeter structure as claimed in claim 31, said fastening means comprising cooperating slide fastener means on said flap portion and on said covering material.

34. A mattress perimeter structure as claimed in claim 31, said covering material comprising mattress ticking.

35. A mattress perimeter structure as claimed in claim 31, said covering material comprising tufted mattress pillow material.

36. A mattress perimeter structure as claimed in claim 31, said covering material comprising a woven breathable fabric.

37. A mattress perimeter structure as claimed in claim 31, said covering material comprising a non-woven breathable fabric.

38. A mattress perimeter structure as claimed in claim 31, said covering material including a pillow top mattress covering.

39. A mattress perimeter structure as claimed in claim 38, said pillow top including a down filling.

* * * * *